US008914939B1

(12) United States Patent
Aragona

(10) Patent No.: US 8,914,939 B1
(45) Date of Patent: Dec. 23, 2014

(54) VACUUM CLEANER

(71) Applicant: Steve Anthony Aragona, Medford, NY (US)

(72) Inventor: Steve Anthony Aragona, Medford, NY (US)

( * ) Notice: Subject to any disclaimer, the term of this patent is extended or adjusted under 35 U.S.C. 154(b) by 73 days.

(21) Appl. No.: 13/872,378

(22) Filed: Apr. 29, 2013

Related U.S. Application Data

(60) Provisional application No. 61/640,430, filed on Apr. 30, 2012.

(51) Int. Cl.
*A47L 9/10* (2006.01)
*A47L 9/14* (2006.01)

(52) U.S. Cl.
CPC ..... *A47L 9/14* (2013.01)
USPC ..... 15/327.2; 15/347

(58) Field of Classification Search
CPC ..... A47L 5/362; A47L 5/365; A47L 9/242; A47L 9/2842; A47L 9/00; A47L 7/0028; A47L 7/0038; A47L 7/0042
USPC ..... 15/327.1, 327.2, 327.6, 344, 347, 15/350–353
See application file for complete search history.

(56) References Cited

U.S. PATENT DOCUMENTS

| | | | | |
|---|---|---|---|---|
| 3,748,834 | A * | 7/1973 | Ruby | 96/403 |
| 4,467,494 | A * | 8/1984 | Jones | 15/353 |
| 4,776,060 | A * | 10/1988 | Chang | 15/339 |
| 4,976,850 | A * | 12/1990 | Kulitz | 210/104 |
| 5,259,087 | A * | 11/1993 | Loveless et al. | 15/327.6 |
| 6,170,118 | B1 * | 1/2001 | McIntyre et al. | 15/327.6 |
| 6,898,821 | B1 * | 5/2005 | Bisbee et al. | 15/353 |
| 7,077,399 | B2 * | 7/2006 | Yamagishi | 273/148 R |

* cited by examiner

*Primary Examiner* — Dung Van Nguyen
(74) *Attorney, Agent, or Firm* — Hooker & Habib, P.C.

(57) ABSTRACT

A vacuum cleaner includes a tank having an internal chamber and a first wall dividing the internal chamber of into a first compartment and a second compartment separated by the wall. A discharge is adapted and configured to discharge waste material vacuumed by the vacuum cleaner into the first compartment of the tank. The first wall includes one or more openings extending through the first wall and fluidly communicating the first and second chambers whereby waste material received into the first compartment that can pass through the one or more openings can pass from the first compartment into the second compartment while waste material that cannot pass through the one or more openings remains in the first compartment.

20 Claims, 2 Drawing Sheets

VACUUM CLEANER

FIELD OF THE DISCLOSURE

This disclosure relates to vacuum cleaners and the like, and in particular in one embodiment discloses a shop vacuum that deposits vacuumed waste into a tank.

BACKGROUND OF THE DISCLOSURE

Shop vacuums are vacuum cleaners having features for vacuuming and picking up waste from shop or factory floors. The waste is deposited into a single tank. The tank is later dumped to remove the waste from the vacuum.

Some of the waste material picked up off the floor may include valuable items. Some of the items may be small and difficult to locate in a single tank, and dumping the waste material for separating those items from the waste takes time and effort.

For example, a shop vacuum is used to vacuum the floor of a factory facility dealing with coins. Coins find their way to the factory floor and are vacuumed into the tank along with the waste. The coins must be manually separated from the waste. This is a time consuming and dirty job.

Thus there is a need for a vacuum cleaner that better separates waste from non-waste.

BRIEF SUMMARY OF THE DISCLOSURE

Disclosed is a vacuum cleaner that better separates waste from non-waste. In one possible embodiment, the vacuum cleaner is a shop vacuum.

The embodiment of a shop vacuum includes a power head that generates suction and discharges the material vacuumed by that suction. The material is discharged into a tank that has a generally horizontal wall that separates the tank into an upper chamber that receives the material discharged by the power head and a lower chamber. The wall includes a mesh or screen that has a mesh or screen size. Material smaller than the screen size falls through the screen and is deposited into the lower chamber. Material larger than the screen size remains in the upper chamber.

In a preferred embodiment the tank is formed from like first and second plastic buckets intended for use as buckets. The buckets are readily available at low cost. A large portion of the bottom wall of the first bucket is removed and covered by the screen. The first bucket is nested inside the second bucket to form the tank, with the bottom, screened wall of the first bucket spaced away from and above the intact bottom wall of the second bucket. The power head is mounted on top of the first bucket.

In a further preferred embodiment, a retaining member is attached to the top of the second bucket. The retaining member has an opening to receive the first bucket. The opening is sized to hold the first bucket the desired height above the bottom wall of the second bucket. The retaining member is preferably formed from a lid configured to fit over the top of the bucket, with the opening cut into the wall.

In possible alternative embodiments, the tank may be constructed as an integral, one piece member that includes the screened wall separating the tank into upper and lower compartments.

In yet other possible embodiments, the tank can include more than one screened wall, the screened walls vertically spaced from one another and dividing the tank into multiple compartments. The screens can filter increasingly fine materials in the direction away from the power head.

Other objects and features of the disclosure will become apparent as the description proceeds, especially when taken in conjunction with the accompanying drawing sheets.

DETAILED DESCRIPTION

Figure 1:
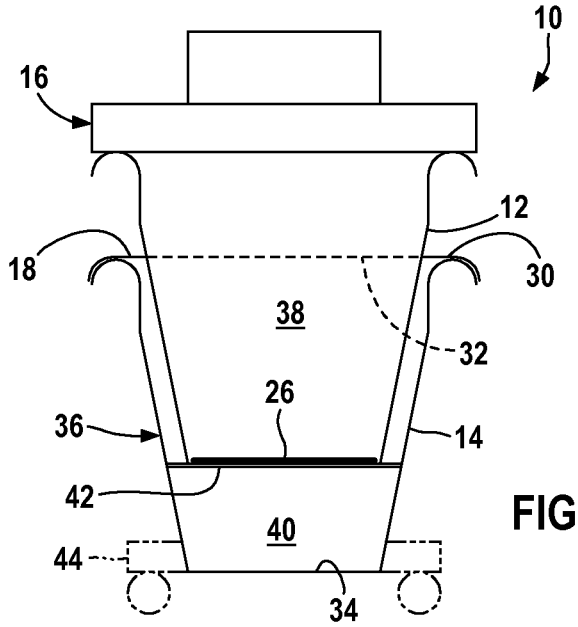
FIG. 1 is a vertical sectional view of a shop vacuum having an upper bucket and a lower bucket.

FIG. 1 illustrates an embodiment of a shop vacuum 10. The shop vacuum 10 includes an upper or first bucket 12, a lower or second bucket 14, the first bucket 12 nested in the second bucket 14 and spaced from the bottom of the bucket 14, a power head 16 mounted on top of the bucket 12 and a retaining member 18 attached to the top of the bucket 14, the retaining member 18 resisting further movement of the bucket 12 towards the bucket 14.

The power head 16 is a commercially available power head and so is not shown in detail. The power head can be a BUCKET HEAD™ power head sold by THE HOME DEPOT (www.homedepot.com) and having Model No. BH0100. Other power heads having different horsepower ratings, sizes, etc. are known and can be adapted for use with a vacuum cleaner of the type disclosed herein.

Figure 2:
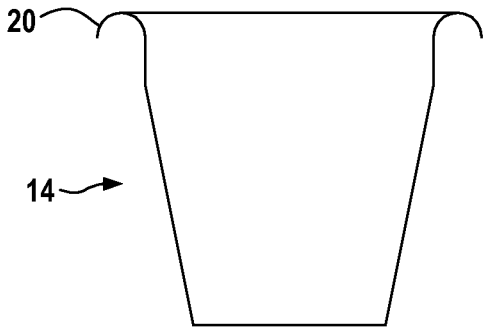
FIG. 2 is a vertical sectional view of the lower bucket shown in FIG. 1.

The lower bucket 14 is shown in FIG. 2. The illustrated lower bucket 14 is a conventional 5-gallon plastic bucket. A suitable bucket is the HOMER BUCKET™ sold by THE HOME DEPOT (www.homedepot.com) and having Model No. 05GLHD2. The illustrated bucket 14 has a height of 14.5 inches and a maximum width at the top of 11.5 inches. The bucket 14 has conventional lid mounting structure 20 located at the upper end of the bucket for attaching or snapping on a lid (not shown) that closes the top of the bucket 14. The sidewalls of the bucket taper inwardly to enable nesting of buckets.

Figure 3:
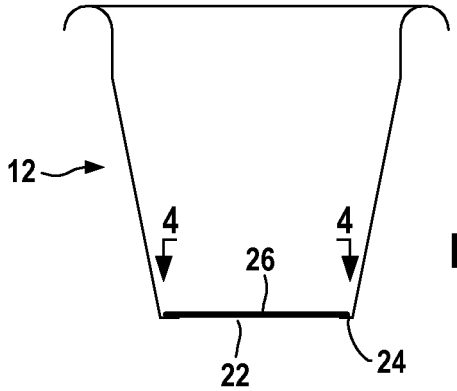
FIG. 3 is a vertical sectional view of the upper bucket shown in FIG. 1.
Figure 4:
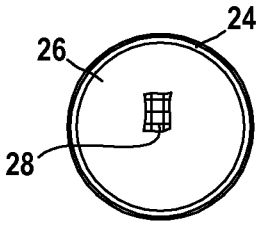
FIG. 4 is a top view of the upper bucket taken from the lines 4-4 shown in FIG. 3.

The upper or first bucket 12 is shown in FIGS. 3 and 4, FIG. 4 being a view taken along lines 4-4 of FIG. 3. The upper bucket 12 is otherwise identical to the bucket 14 but modified for use in the vacuum 10 and so only differences will be discussed.

A circular opening 22 is cut into the bottom wall 23 of the bucket 12 to define an annular flange 24 formed from the remaining portion of the wall. The flange 24 supports a screen or mesh 26 that is glued to or otherwise supported on top of the flange 24 and covers the opening 22. The illustrated screen 26 defines through-openings 28 (to simplify the drawing, only a portion of the screen 26 is shown in FIG. 4).

The retaining member 18 is made from a lid 30 that fits the bucket 14 and is snapped onto the top of the bucket 14 in a conventional manner. A centered, circular opening 32 is cut in the lid and is sized to closely receive the lower end of the upper bucket 12 to a predetermined depth as shown in FIG. 1 whereby the screen 26 is spaced away from the bottom wall 34 as shown.

To form the shop vacuum 10, the upper bucket 12 is inserted into or nests with the lower bucket 14, and the retaining member 18 cooperates with the nested buckets 12, 14 to form a tank 36 that includes the interior of the upper bucket 12 and the interior of the lower bucket 14 not receiving the bucket 12. The upper bucket 12 can be rotated relative to the lower bucket 14 during insertion so that handles (not shown) attached to the buckets does not interfere with nesting of the buckets 12, 14.

The screen 26 now vertically divides the tank 36 into upper compartment 38 and lower compartment 40. In operation, material sucked up by the power head 16 is discharged into the upper chamber 38. Material that can fit through or otherwise passes through or falls through the screen openings 28 are received into the lower chamber 40. The remaining material remains in the upper chamber 38. In the illustrated embodiment the openings 28 are sized to prevent US denomination coins to pass through the screen 26.

In the illustrated embodiment a metal rod 42 extends through and is supported by the bucket 14. The rod 42 is disposed and configured to limit movement of the first bucket 12 into the second bucket 14 and is intended to prevent the suction generated by the head 16 from pulling the second bucket 14 fully into the first bucket 12.

In other possible embodiments, the vacuum 10 can rest on wheels or casters 44 (shown in phantom in FIG. 1) that allow rolling the shop vacuum 10 from one location to another.

In yet other possible embodiments the bucket 12 can rest on support structure, such as rods 44 (shown in phantom in FIG. 1) that space the bottom of the bucket 12 above the bottom of the bucket 14 instead of relying on (or in addition to) an interference between the buckets 12, 14. In yet other embodiments, the tank defining the chambers 38, 40 can be formed as a single integral unit.

In yet further embodiments formed using separate members corresponding to the pails or buckets 12, 14, the shape and "nestability" of the two members can differ from the illustrated embodiment 10. For example, one member may be designed to nest in the other member with the bottom of the inner member spaced from the bottom of the outer member so that a retaining member or sealing member corresponding to the lid member 18 is not needed.

My Patent Application No. 61/640,430 filed Apr. 30, 2012 is incorporated by reference as if fully set forth herein.

While this disclosure includes one or more illustrative embodiments described in detail, it is understood that the one or more embodiments are each capable of modification and that this disclosure and its teachings are not limited to the precise details set forth herein but include such modifications that would become obvious to a person of ordinary skill in the art after reading this disclosure, as well as such changes and alterations that fall within the purview of the following claims.

The invention claimed is:

1. A vacuum cleaner comprising:

a tank having an internal chamber and a first wall dividing the internal chamber of into a first compartment and a second compartment separated by the wall;

a discharge adapted and configured to discharge waste material vacuumed by the vacuum cleaner into the first compartment of the tank;

the first wall comprising one or more openings extending through the first wall and fluidly communicating the first and second chambers whereby waste material received into the first compartment that can pass through the one or more openings can pass from the first compartment into the second compartment while waste material that cannot pass through the one or more openings remains in the first compartment; and wherein the tank comprises first and second members not integral with one another, each member having a bottom and an annular wall extending away from the bottom, the first member nested in the second member with the bottom of the first member at least partially forming said first wall.

2. The vacuum cleaner of claim 1 wherein the tank extends along a vertical axis; and the one or more openings are disposed in a portion of the first wall that is substantially transverse to the axis.

3. The vacuum cleaner of claim 1 wherein the tank has an open top and the vacuum cleaner comprises a power head closing the top of the tank.

4. The vacuum cleaner of claim 3 wherein the power head is removably mounted to the tank.

5. The vacuum cleaner of claim 1 wherein the said one or more openings each extends through the bottom of the first member, and each first and second member is otherwise identical to one another.

6. The vacuum cleaner of claim 5 wherein the bottom of the first member comprises a through-opening bordered by an annular portion of the bottom of the first member, and said one or more openings is each disposed in a third member supported on the annular portion of the bottom of the first member.

7. The vacuum cleaner of claim 5 wherein the second member is a plastic bucket having structure configured and adapted for mounting a lid on the bucket.

8. The vacuum cleaner of claim 1 wherein the first wall comprises an annular portion extending from the second member to the first member and surrounding the first member.

9. The vacuum cleaner of claim 8 comprising a lid and wherein the second member is a plastic bucket, the lid on the plastic bucket, a portion of the lid cut away and forming said annular portion.

10. The vacuum cleaner of claim 1 wherein the first wall comprises an annular portion surrounding and engaging the first member, the annular portion and the first member configured to cooperate with one another to resist movement of the bottom of the first member towards the bottom of the second member.

11. The vacuum cleaner of claim 1 wherein the annular wall of the first member tapers outwardly in the direction away from the bottom of the first member.

12. The vacuum cleaner of claim 1 wherein the first wall comprises a mesh portion forming said one or more openings.

13. A vacuum cleaner comprising:

a tank having an internal chamber and a first wall dividing the internal chamber of into a first compartment and a second compartment separated by the wall;

a discharge adapted and configured to discharge waste material vacuumed by the vacuum cleaner into the first compartment of the tank;

the first wall comprising one or more openings extending through the first wall and fluidly communicating the first and second chambers whereby waste material received into the first compartment that can pass through the one or more openings can pass from the first compartment into the second compartment while waste material that cannot pass through the one or more openings remains in the first compartment; and wherein the tank comprises first and second members not integral with one another, the first member nested in the second member, and a support member supported by the second member disposed and configured to limit movement of the first member into the second member.

14. The vacuum cleaner of claim 13 wherein the said one or more openings each extends through the bottom of the first member, and each first and second member is otherwise identical to one another.

15. The vacuum cleaner of claim 14 wherein the bottom of the first member comprises a through-opening bordered by an annular portion of the bottom of the first member, and said one or more openings is each disposed in a third member supported on the annular portion of the bottom of the first member.

16. The vacuum cleaner of claim 14 wherein the second member is a plastic bucket having structure configured and adapted for mounting a lid on the bucket.

17. The vacuum cleaner of claim 13 wherein the first wall comprises an annular portion extending from the second member to the first member and surrounding the first member.

18. The vacuum cleaner of claim 17 wherein the second member is a plastic bucket having a lid, a portion of the lid cut away and forming said annular portion.

19. The vacuum cleaner of claim 13 wherein the support member is a rod extending through the second member and supporting the first member.

20. The vacuum cleaner of claim 13 wherein the annular wall of the first member tapers outwardly in the direction away from the bottom of the first member.

* * * * *